US005800329A

United States Patent [19]

Fager et al.

[11] Patent Number: 5,800,329

[45] Date of Patent: Sep. 1, 1998

[54] APPARATUS FOR FOLDING SHEET BLANKS BY ENDLESS CONVEYOR BELTS

[75] Inventors: Lars Fager, Halmstad; Bengt Åsberg, Örebro, both of Sweden

[73] Assignee: Emba Machinery AB, Orebro, Sweden

[21] Appl. No.: 700,501

[22] PCT Filed: Feb. 3, 1995

[86] PCT No.: PCT/SE95/00107

§ 371 Date: Aug. 2, 1996

§ 102(e) Date: Aug. 2, 1996

[87] PCT Pub. No.: WO95/21055

PCT Pub. Date: Aug. 10, 1995

[30] Foreign Application Priority Data

Feb. 4, 1994 [SE] Sweden ..... 9400379

[51] Int. Cl.[6] ..... B31B 5/58

[52] U.S. Cl. ..... 493/417; 493/422; 493/423; 493/436

[58] Field of Search ..... 493/417, 418, 493/422, 423, 436, 441, 446, 450

[56] References Cited

U.S. PATENT DOCUMENTS

| | | | |
|---|---|---|---|
| 1,313,712 | 8/1919 | MacFarland | 493/423 |
| 2,896,517 | 7/1959 | Labombarde | 493/436 |
| 2,931,277 | 4/1960 | Lombard . | |
| 3,122,070 | 2/1964 | Kauffman . | |
| 3,797,371 | 3/1974 | Randle | 493/418 |
| 4,508,529 | 4/1985 | Feldkamper | 493/441 |
| 4,588,393 | 5/1986 | Cogswell | 493/441 |
| 4,614,512 | 9/1986 | Capdeboscq . | |
| 5,092,827 | 3/1992 | McAdam | 493/423 |
| 5,094,658 | 3/1992 | Smithe | 493/446 |
| 5,114,392 | 5/1992 | McAdam | 493/423 |

FOREIGN PATENT DOCUMENTS

| | | |
|---|---|---|
| 388 649 | 9/1990 | European Pat. Off. . |
| 29 11 969 | 10/1980 | Germany . |

*Primary Examiner*—Joseph J. Hail, III
*Assistant Examiner*—Christopher W. Day
*Attorney, Agent, or Firm*—Sughrue, Mion, Zinn, Macpeak & Seas, PLLC

[57] ABSTRACT

Apparatus for folding sheet blanks (1), e.g. for boxes and trays from carton or corrugated cardboard. It includes press means (6, 7) attached to at least one endless conveying means (10). The press means are intended to coact with selected parts (2, 3) of the blanks for folding them up or down from the plane of the blank during their passage through the apparatus. The blanks are arranged to be conveyed through the apparatus at the same speed as that at which the conveying means is driven. The latter is guided in a helical path by an elongate, rigid structure (8, 9) forming continuous support for the conveying means. During the entire folding operation the operative ones of the press means attached to the conveying means press against the same area on the part of the blank with which they coact.

8 Claims, 5 Drawing Sheets

APPARATUS FOR FOLDING SHEET BLANKS BY ENDLESS CONVEYOR BELTS

FIELD OF THE INVENTION

The present invention relates to apparatus for folding sheet blanks, e.g. from carton or corrugated cardboard. The sheets are suitably prepared with slits and crease lines in order to form blanks, e.g. for boxes, trays and the like. Folding is carried out during continuous conveyance of the respective blank in the longitudinal direction of the apparatus. The blanks can be fed to the apparatus either via a separate feed unit or directly from the preceding unit in a production line. Folding is performed so that the side panels of the blank are folded upwards or downwards from the plane of the blank, folding being subsequently carried on until the side panels meet above or below the middle portion of the blank. The apparatus includes means with associated guide and drive means for conveying the blanks and folding in the side panels.

BACKGROUND ART

Apparatus performing folding operations of this kind on corrugated cardboard or carton are generally known in the paper industry.

Known apparatus for the kind of folding mentioned above, irrespective of whether folding takes place upwards or downwards, urges the side panels through a folding movement with the aid of rods, belts, compressed air, carve rollers, and/or vacuum. The elements acting on the side panels are either driven for accompanying the feed movements of the blank, or they are passive, so that the feed movement of the blank forces the side panels to fold together. In the case where the elements are driven, the object is to get the movement to coincide with the movement of a given point on the panel during the folding operation. Irrespective which of the principles mentioned is applied in the known apparatus, the movement does not coincide exactly with that of the side panels during folding, which takes place during conveyance of the blank. This signifies that movement occurs between the side panel and the element causing the folding movement, a friction force between the two then urging the panel in an undesired direction. This is one reason why the result of the folding operation is not always satisfactory with present folding apparatus. Other causes negatively affecting the folding result are poor or deviating crease lines, which steer folding so that the side panels are put together unevenly. The folding result is also affected by the material, and the orientation of the corrugations, if corrugated cardboard blanks are used. With present folding apparatus the result will often be that the folded side panels do not finish up in desired positions when put together, since in practice it will be the crease lines, possible folding rails and the composition of forces that decide the folding result.

When a side panel is folded inwards, independent of whether folding takes place upwards or downwards from the original plane, a given point on the panel describes an arcuate movement, if no account is paid to the feed movement of the sheet blank. The centre of this movement should lie in the upper or lower plane of the sheet, according to whether folding is upwards or downwards. If the feed movement is added to the described movement, an elongate, helical turning movement about this centre is obtained. Optimum for a folding apparatus would thus be to follow this turning movement in order to avoid any relative movement between a given point on the panel and a pressing element of the folding apparatus. The pressing element should also press perpendicular to the panel for obtaining the most favourable folding process.

The known apparatuses do not work according to this principle, consequently the above-mentioned relative movement has not been eliminated in them either. Many attempts have been made to attain an ideal movement, for example in the European patent no 0086153, relating to "A Machine for Folding Sheets". A turning movement in conjunction with the feed movement is indeed utilised in this machine, at the same time as the press elements used press substantially perpendicularly against the panels. However, the press elements are not guided in the circular arc mentioned above, since they are carried by a belt which is only guided at certain points, and it can not be curved between the guide rollers. In addition, the belt is not centred above the crease line, but extends diagonally in relation to it. A circular arc with the line as centre cannot therefore be described by the press elements as they are conveyed. Accordingly, there is also a relative movement in this machine between the respective press element and side panel, and the movement causes forces to act in undesired directions on the side panel. It should be noted that folding in this machine, as with remaining known apparatus, is guided entirely by the crease line and any folding rails. With the aid of folding rails the folding can only be guided during its initial phase, since there is no room for them later between the middle and side panels. This results in that the final folding phase will not be controlled at all.

THE OBJECT OF THE INVENTION

The chief object of the present invention is to provide a folding apparatus in which the above-mentioned drawbacks have been eliminated, and which enables the implementation of a completely controlled folding operation.

SHORT DESCRIPTION OF THE INVENTION

The above-mentioned objects are achieved with a folding apparatus, which includes press means exercising a pressure at a fixed point on the respective side panel throughout the entire folding process. The position of the side panels may then be controlled throughout the whole of the folding process, thus ensuring correct folding. This takes place by the press means engaging and holding fast against the side panels, as well as taking them in a smooth folding movement about a desired folding centre simultaneously as the conveying movement is executed in the longitudinal direction of the apparatus. During the entire folding operation the respective press means in accordance with the present invention presses on, and keeps at, a given point on the panel that is to be folded, thus ensuring that the position of the panel can be guided to a desired terminal position. This results in the positions of the panels in relation to each other and to the central panels being guided so that the sheet blank may be folded and possibly put together exactly in accordance with predetermined requirements. The crease lines and material properties of the blank consequently do not affect the folding result as with folding in known apparatus.

BRIEF DESCRIPTION OF THE DRAWINGS

The apparatus in accordance with the present invention is described in more detail below with the aid of an embodiment example, which is not to be considered as limiting the scope of the invention, where folding takes place downwards and is taken through 180° for the respective panel. This is shown on the accompanying drawings, where.

DESCRIPTION OF A PREFERRED EMBODIMENT

Figure 1:
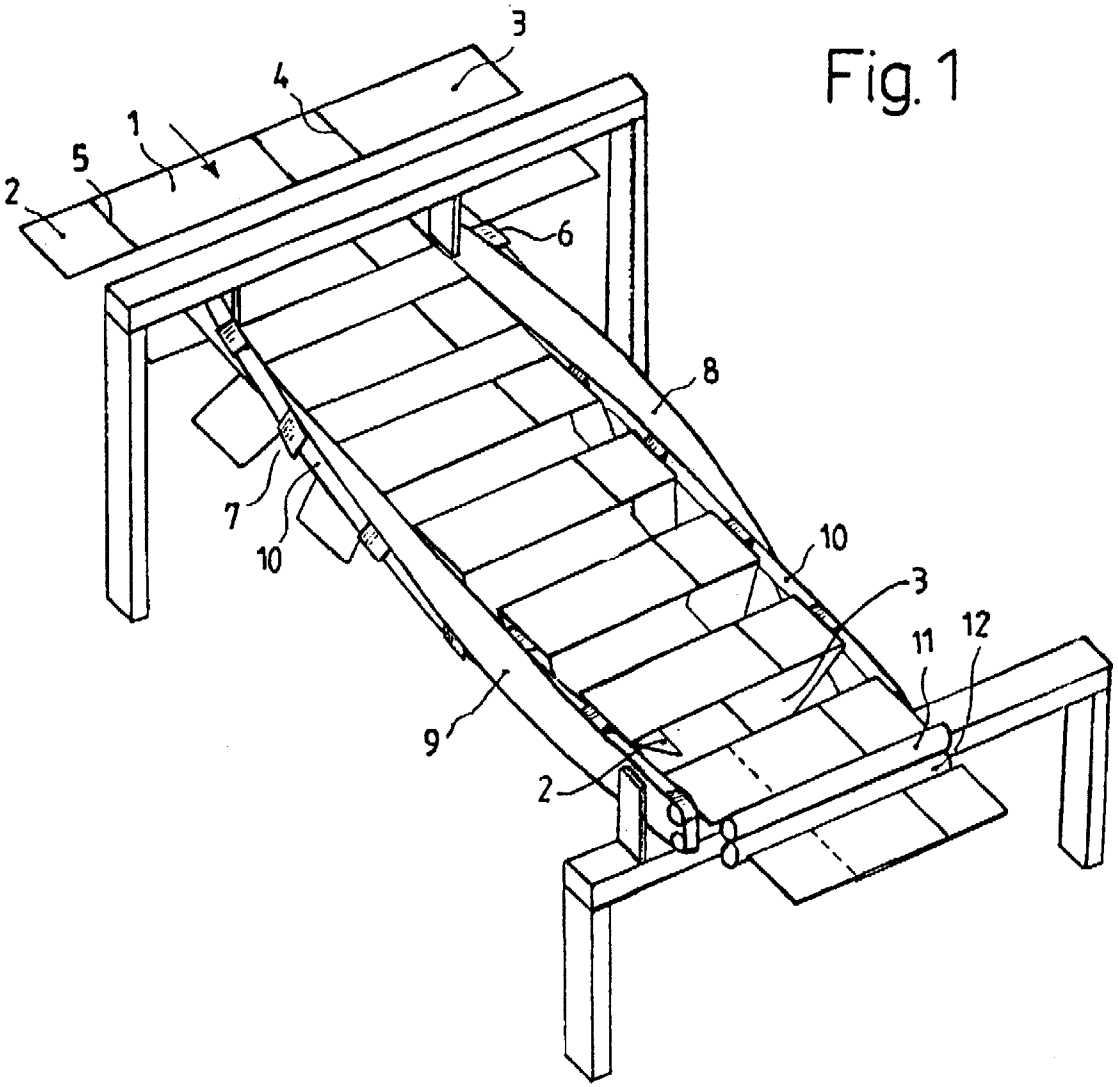
FIG. 1 is a schematic, perspective view of a folding apparatus in accordance with the above-mentioned embodiment example.
Figure 2:
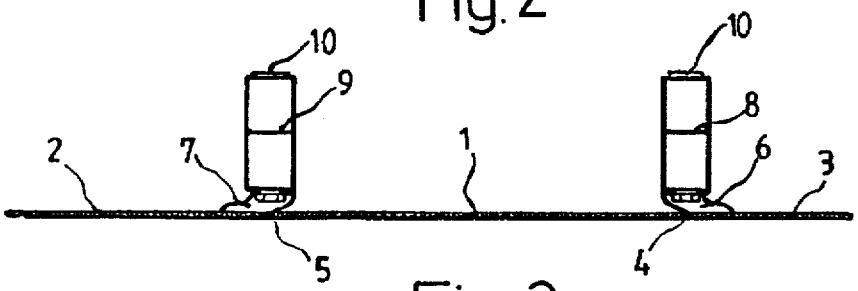
FIGS. 2, 3, 4, 5 are schematic cross sections through the apparatus, taken at four different stages during the folding process.
Figure 3:
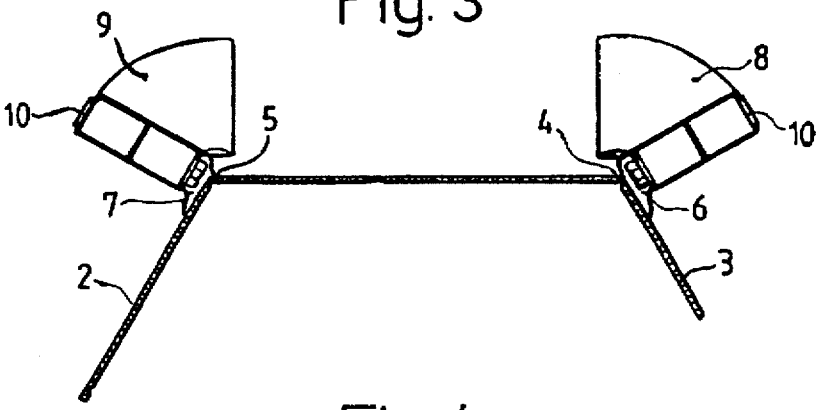
Figure 4:
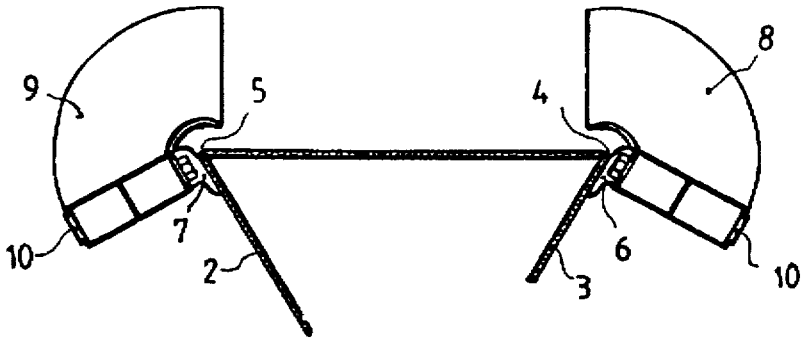

It is shown in FIG. 1 how the sheet blank is fed into the folding apparatus in accordance with the present invention, and is folded together while being conveyed. The side panels 2, 3, which are connected to the central panels of the blank along crease lines 4, 5 are folded downwards and inwards, in this embodiment, and about the respective crease line so that they meet after a fold of 180°.

Folding takes place by press means 6, 7 also serving as conveying dogs, fixing onto the side panels 2, 3 and being driven in a movement such that they urge the panels to an exact folding movement about the central axis of the respective crease line 4 or 5. In this embodiment beams 8, 9 ensure the desired movement of the press means 6, 7, the beam 8 being twisted to the left about the central axis for the crease line 4, and the beam 9 to the right about the central axis for the crease line 5.

The press means 6, 7 are fixed to their respective endless conveying means, which in the illustrated embodiment takes the form of a toothed belt 10. The belts 10 with their respective means 6 or 7 are guided by the respective beams 8 and 9, so that they continuously follow a desired movement of the side panels 2, 3 about the central axes of the crease lines 4, 5. All this takes place while the blank 1 is conveyed at a desired speed in its horizontal plane through the apparatus.

The speed of the endless belts 10 is accordingly synchronised with the desired conveying speed of the blank in its horizontal plane. When the blank is fully folded it is passed through a pair of rollers 11, 12, which compress the ready-folded blank 13 so that folds and any gluing are fixed.

Figure 5:
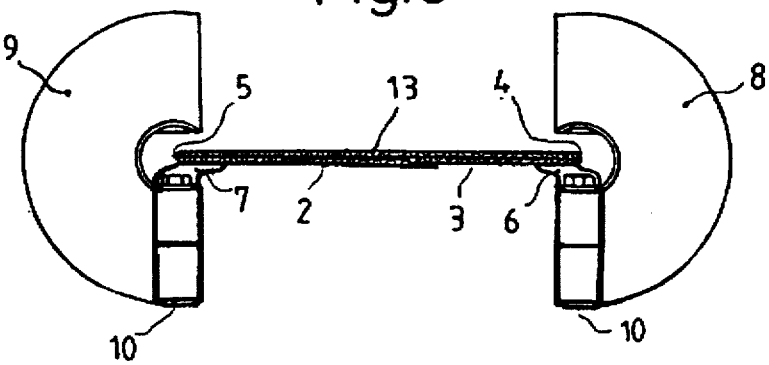

The movement described by the pressing and conveying means 6, 7 will be better understood from FIGS. 2, 3, 4 and 5. These figures illustrate four different stages of folding in accordance with the embodiment example. The flat blank 1 is engaged by the pressing and conveying means 6, 7 on the respective side panel 2, 3 according to FIG. 2. The side panels 2, 3 are then moved smoothly out of their initial plane in accordance with FIGS. 3 and 4, for finally meeting each other so that a ready-folded blank 13 is obtained, as illustrated in FIG. 5.

The pressing and conveying means 6, 7 are constrainedly guided by the twisted beams 8, 9 via the endless belts 10 such as to describe a smooth, circular movement about the desired folding centre. With this in mind the beams define helical paths forming continuous support for conveying and for guiding the belts. The respective helical path has its central axis substantially coinciding with the axis about which folding is to take place. In addition, each path is centred in relation to the folding axis.

The given points at which the press means 6, 7 engage the side panels 2, 3 in the first stage (FIG. 2) remain the same during the entire folding operation. The blank is conveyed horizontally, utilising the means 6, 7 while the side panels 2, 3 are folded to their desired positions. Since the press means are fixed at a given point on the respective side panel 2 or 3, folding may be guided during the entire operation, so that desired overlapping (FIG. 5) may be obtained for the ready-folded blank 13. In the illustrated embodiment only the mutual relationship of the beams 8, 9 at the initial (FIG. 2) and final (FIG. 5) stages needs to be adjusted to change the amount of overlap. Folding will thus not be dependent on folding rails, and is not affected by imperfections in crease lines in the blank.

The folding apparatus may possibly be equipped with a horizontal vacuum conveyor or the like between the beams 8, 9 in accordance with prior art, to assist with the horizontal conveyance of the blank 1 during the folding operation.

Figure 6:
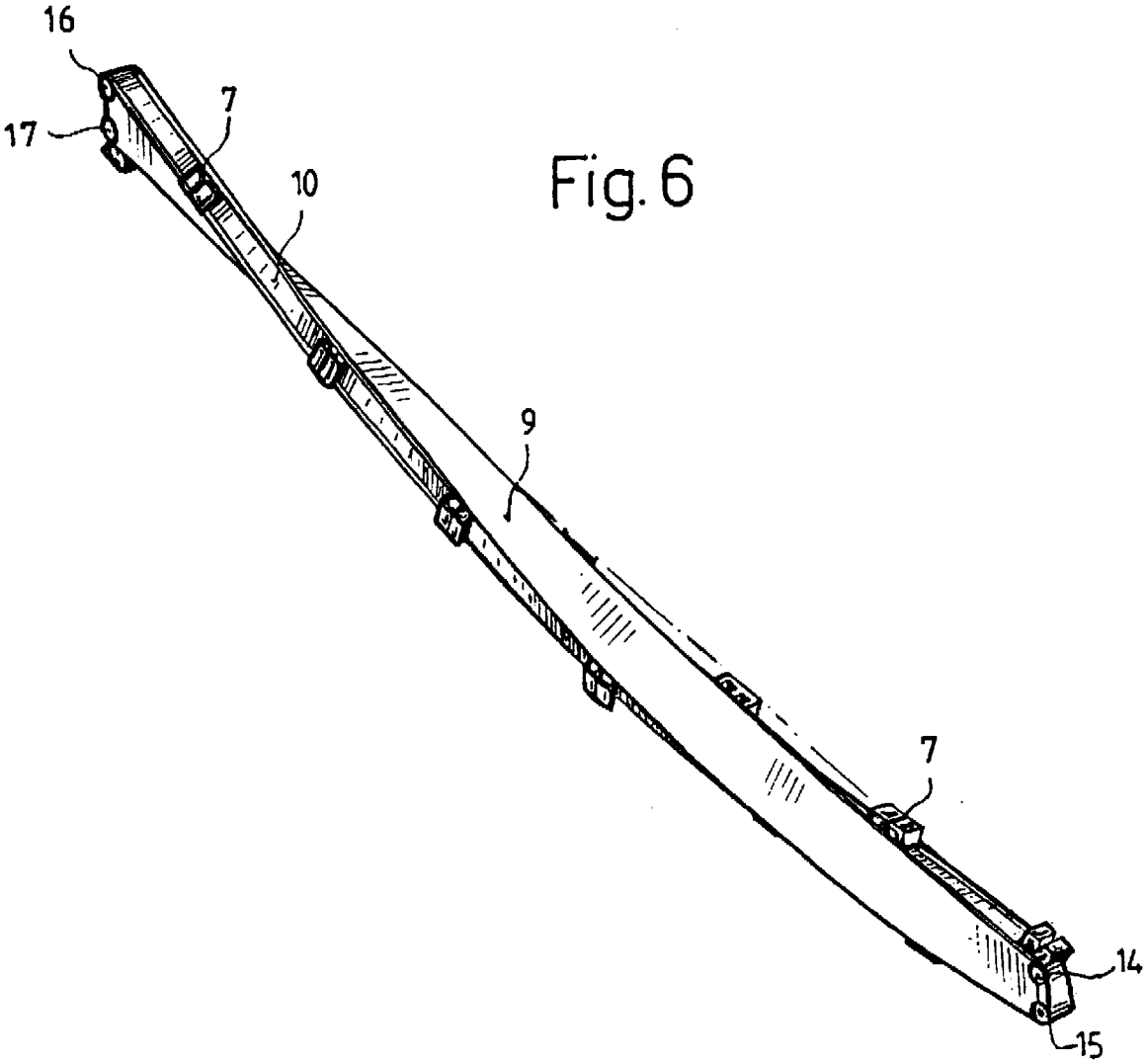
FIG. 6 is a perspective view of a beam in the apparatus according to FIG. 1, provided with press means driven along the beam.

In FIG. 6 there is illustrated an individual beam 9, and here it will be seen that when the grip between a side panel and press means 7 has ceased, the means is taken downwards over guide pulleys 14, 15 with the aid of the belt 10. In this way, the belt 10 and accompanying means 7 obtain a new radius and angle of attack about the centre of twisting of the beam 9. The positional and directional change is, in the illustrated embodiment, arranged such that it coincides with the position and direction on the opposite side of the beam 9. Accordingly, return transport of the pressure means 7 can take place in a controlled manner on this side. At the other end of the beam 9 the means 7 is guided once again via the endless belt 10 such as to pass over two guide pulleys 16, 17, so that the position and direction agree with the side of the beam 9 which is nearest the side panels 2. The transport of the pressure means 7 is thus guided by the belt 10, guide rollers 14, 15, 16, 17 and the beam 9 so that movement on one side of the beam is in exact agreement with the movement of the side panel 2 during the entire folding operation.

On the opposite side of the beam 9 the return transport of the conveying means may take place without their colliding with subsequent blanks. The other beam 8 is twisted in a corresponding manner so that associated press means 6 accompany the movement of the other side panel 3.

Driving of the endless toothed belts 10 is by having one of the guide pulleys 14, 15, 16, 17 driven on the respective beam 8, 9.

Figure 7:
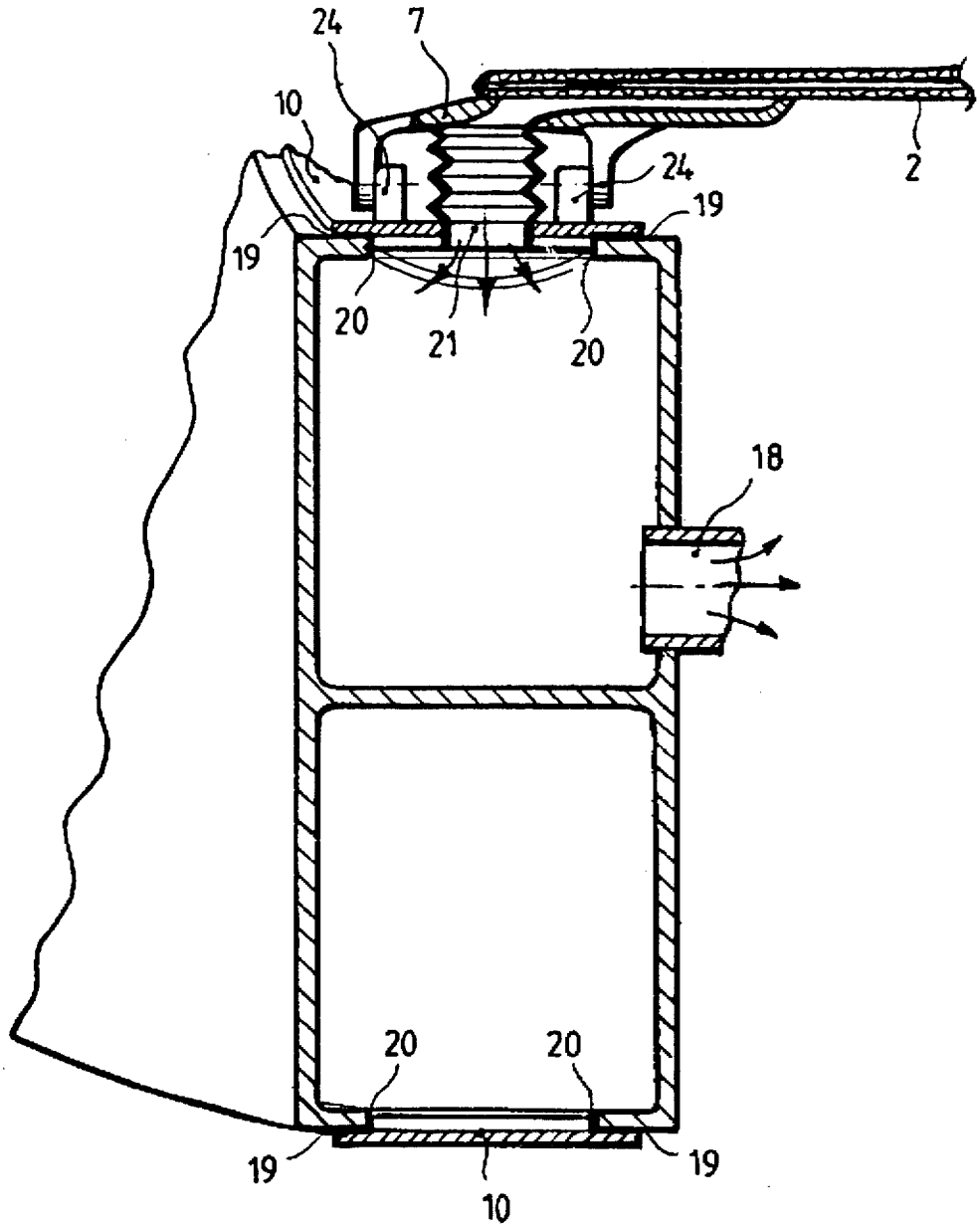
FIG. 7 is a schematic cross section through the beam and a press means at the final phase of the folding process.
Figure 8:
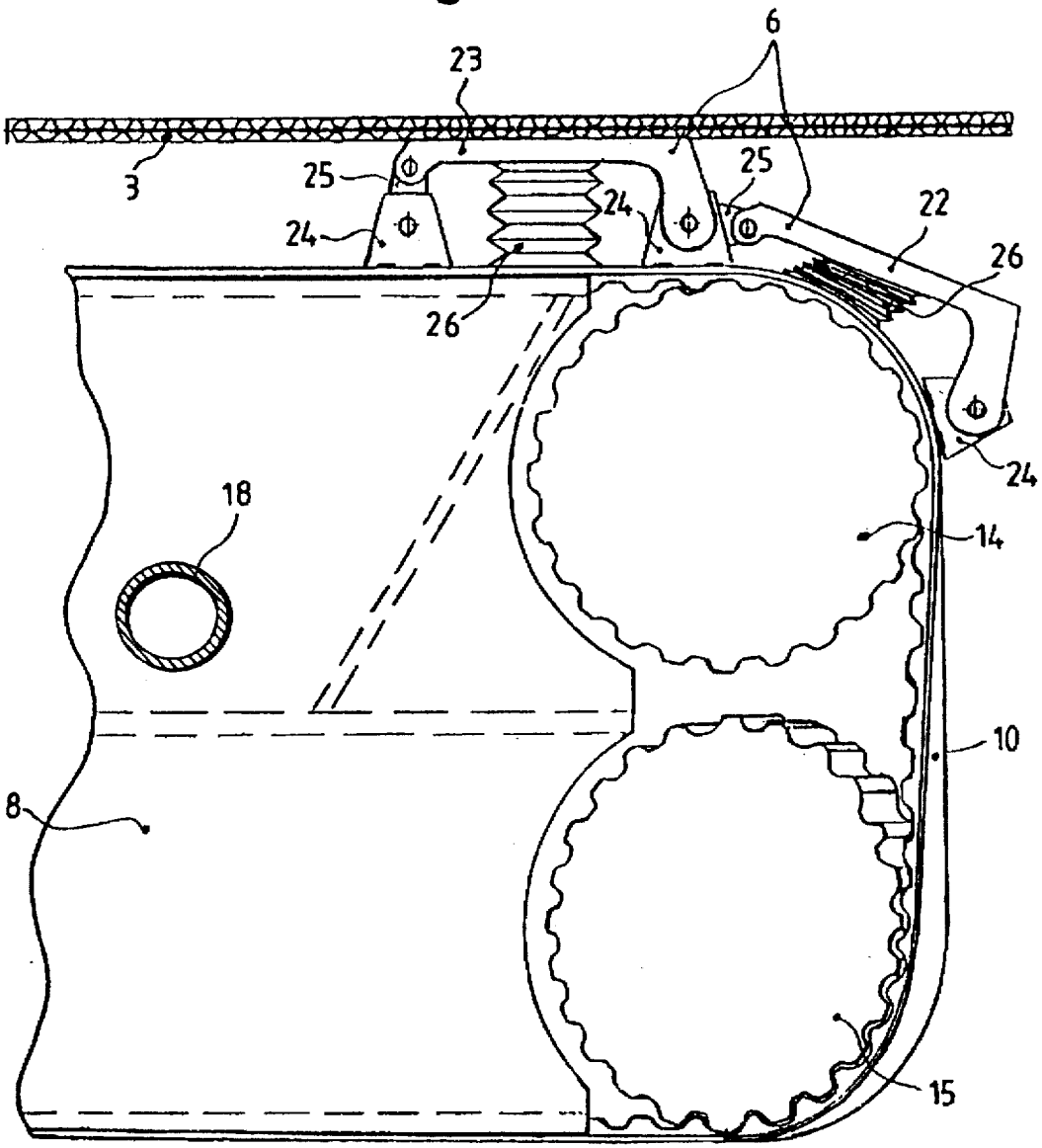
FIG. 8 is a schematic side view of the beam end on completion of the folding operation.

FIGS. 7 and 8 illustrate in more detail how the pressing and conveying means 6, 7 are implemented in this embodiment. The means 6, 7 for the beams 8, 9 are mutually mirrored replicas to suit left and right-hand twisting for engaging onto the respective side panel 3, 2 during the folding operation. It will be seen from the section in FIG. 7 that the part of the beam 9 situated closest to the side panel 2 is implemented as a vacuum box in which a sub-pressure is maintained by an unillustrated suction fan via a conduit connection 18. The sub-pressure in the vacuum box keeps the endless belt 10 against the coacting vacuum side of the beam 9. The edge portions 19 of the belt are unserrated for sealing against the sub-pressure in the vacuum box of the beam 9. In the illustrated embodiment the teeth in the middle part of the belt may thus be guided laterally against the edges of a longitudinal slot 20 in the vacuum box, so that during conveying the belt is kept in a given position and centred in relation to the crease line. A hole 21 is made in the belt 10 directly opposite each press means 7 so that vacuum reaches the outer end of the means formed as a suction cup and in contact with the side panel 2, the vacuum thus ensuring that the element 7 keeps the panel fixed in a desired position.

The illustrated pressing and conveying means 6, 7 each comprises two members 22, 23 (see FIG. 8) implemented such that when they move along the vacuum side of their respective beam 8, 9 they describe together a plane corresponding to the desired plane of the side panel 3 or 2. In this embodiment, the members 22, 23 are implemented as bridges which are hingedly mounted on the fastenings 24, 25 attached to the belt 10 for accompanying its movement along the respective beam 8, 9. The sub-pressure comes from the vacuum box of the beam to the members 22, 23 via bellows connections 26. This implementation enables the members 22, 23 to be automatically urged towards the belt and out of engagement with the respective side panel when they have passed the end of the vacuum box to continue over the guide pulley 14. At this stage the folding operation has also terminated and the folded blank 13 has been conveyed into the nip of the rollers 11 and 12, according to FIG. 1.

The invention is naturally not restricted to the described embodiment. For example, the endless conveying means could have a differently configured cross section, so that guiding and sealing against the beams is achieved in another way. The conveying means could also comprise some other form of endless belt, rope or chain. In addition, adherence of the pressing and conveying means to the side panels could be accomplished by some known means other that vacuum, e.g by mechanical engagement. The implementation of the beams may be varied, particularly the cross section thereof and the side against the conveyor means return part, e.g. the beams could have cylindrical cross section and guide means along their cylindrical surface for the conveying means. Return of the press means may also take place away from the beam. The press means itself may be given various configurations, whereat desired hinge functions, for example, could be obtained by utilising the material properties of the press means. The number of such means per sheet blank that is folded may be selected according to requirements. A machine in accordance with the invention may include fold rails as extra aids, even if such are not necessary.

We claim:

1. Apparatus for folding sheet blanks (1), including at least one conveyor (10) provided with press means (6, 7) for coaction with selected parts (2, 3) of the blanks for folding said parts inwards into engagement with inwardly situated portions of the blanks during the passage thereof through the apparatus, said passage taking place at the speed at which said conveyor is driven, wherein the conveyor is continuously guided along a helical path by an elongate, rigid structure (8, 9) forming continuous support for the conveyor, and a central axis of the helical path substantially coincides with a crease axis about which folding takes place, so that each of the press means attached to the conveyor presses against a same, fixed point on a part of the blank it coacts with during an entire folding operation to attendantly eliminate any relative movement and resulting friction between a press means and a part of the blank engaged thereby.

2. Apparatus as claimed in claim 1, wherein the press means (6, 7) fixedly hold the parts (2, 3) of the blank and contribute to feeding the blank along said apparatus.

3. Apparatus as claimed in claim 1, wherein the rigid structure includes a beam defining a helical path for the conveyor in the form of an endless belt, said belt extending centrally in relation to said crease axis (4, 5) about which folding takes place.

4. Apparatus for folding sheet blanks (1), including at least one conveyor (10) provided with press means (6, 7) for coaction with selected parts (2, 3) of the blanks for folding said parts inwards into engagement with inwardly situated portions of the blanks during the passage thereof through the apparatus, said passage taking place at the speed at which said conveyor is driven, wherein the conveyor is continuously guided along a helical path by an elongate, rigid structure (8, 9) forming continuous support for the conveyor, and a central axis of the helical path substantially coincides with a crease axis about which folding takes place, so that each of the press means attached to the conveyor presses against a same, fixed point on a part of the blank it coacts with during an entire folding operation, wherein the rigid structure includes a beam defining a helical path for the conveyor in the form of an endless belt, said belt extending centrally in relation to said crease axis (4, 5) about which folding takes place, and wherein the beam is implemented as a vacuum box and at least one opening or slot (20) is made in the path guiding the belt so that a sub-pressure prevailing in the beam (8, 9) urges the belt into sealing engagement with the beam.

5. Apparatus as claimed in claim 4, wherein the belt (10) is provided with openings (21) at the attachment points of the press means (6, 7) to said belt and in that said press means are suction cups for holding fast the respective part (2, 3) of the blank (1) by utilising the sub-pressure in the beam (8, 9).

6. Apparatus as claimed in claim 4, wherein the belt (10) is of the timing drive or toothed type, there being a longitudinal, central slot (20) in the path guiding said belt, which has flat edge portions (19), its teeth being accommodated in said slot for guiding said belt, while said edge portions seal against said path on either side of said slot.

7. Apparatus as claimed in claim 4, wherein the beam (8, 9) guiding the endless belt (10) is provided with guide pulleys (14, 15) at its ends, and is implemented such that it also guides the return transport of the press means (6, 7).

8. Apparatus as claimed in claim 7, wherein the press means (6, 7) are suction cups are mounted on the belt such that they are automatically urged towards the belt as it passes over a guide pulley (14, 15).

* * * * *